United States Patent [19]

Kramer

[11] 4,277,910

[45] * Jul. 14, 1981

[54] INFANT PACIFIER COMBINATION

[76] Inventor: Remi T. Kramer, 8661 Delmonico, Canoga Park, Calif. 91304

[ * ] Notice: The portion of the term of this patent subsequent to Feb. 19, 1997, has been disclaimed.

[21] Appl. No.: 93,045

[22] Filed: Nov. 13, 1979

Related U.S. Application Data

[63] Continuation-in-part of Ser. No. 921,202, Jul. 3, 1978, Pat. No. 4,188,747.

[51] Int. Cl.[3] ..... A63H 3/00

[52] U.S. Cl. ..... 46/116; 128/360

[58] Field of Search ..... 128/133, 359, 360, 252; 215/11 R; 46/116, 163, 171, 117, DIG. 1

[56] References Cited

U.S. PATENT DOCUMENTS

| | | | |
|---|---|---|---|
| 2,675,644 | 4/1954 | Senior et al. | 46/117 X |
| 2,711,052 | 6/1955 | Brayford | 46/116 |
| 2,860,639 | 11/1958 | Hoover | 128/359 |
| 4,197,604 | 4/1980 | Nakamura | 46/163 X |

*Primary Examiner*—Stephen C. Pellegrino
*Assistant Examiner*—Michael H. Thaler
*Attorney, Agent, or Firm*—Vernon D. Beehler

[57] ABSTRACT

An object or toy, naturally attractive to small children and infants, is provided with a receptacle at an advantageous location for reception of a nipple serving as a pacifier. The nipple in turn is one suitable for being individually sterilized from time to time. The receptacle is therefore provided with a releasable clamp, effectively concealed within the toy, but capable of releasably grasping a smoothly contoured projection on one end of the nipple to hold it in position on the toy from which it can be released at will.

5 Claims, 11 Drawing Figures

Fig. 7.
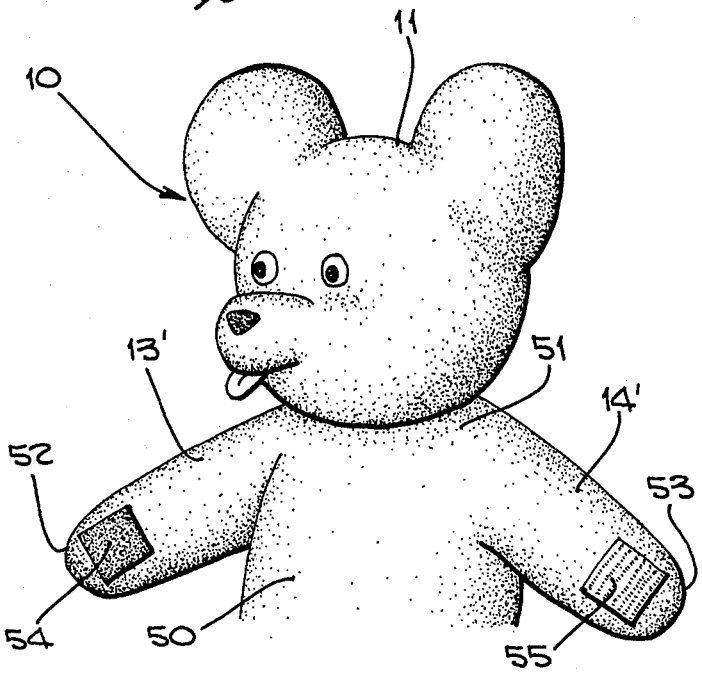
Fig. 9.
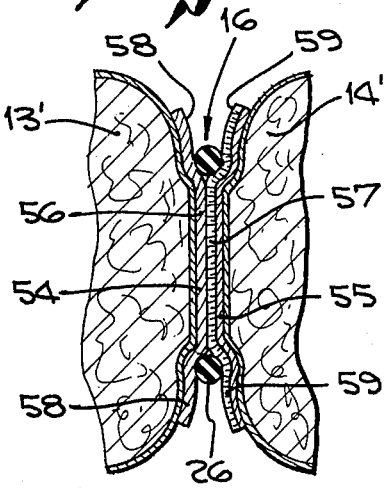
Fig. 10.
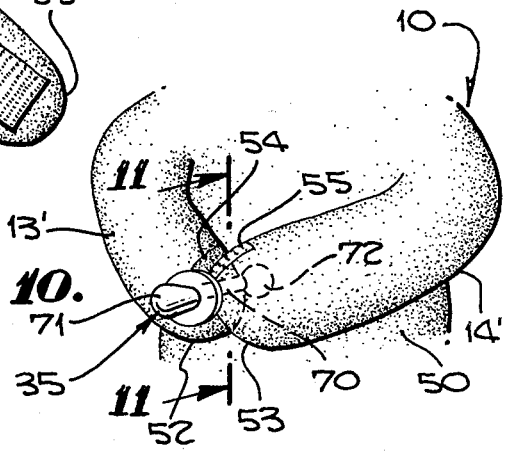
Fig. 8.
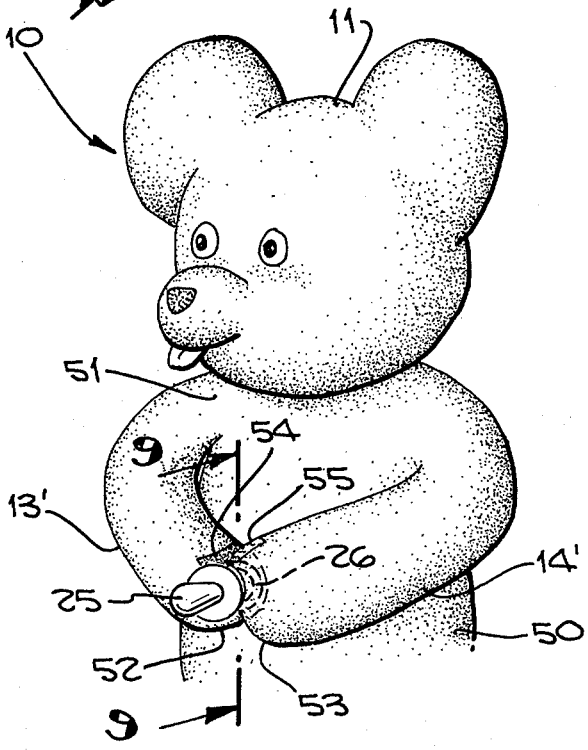
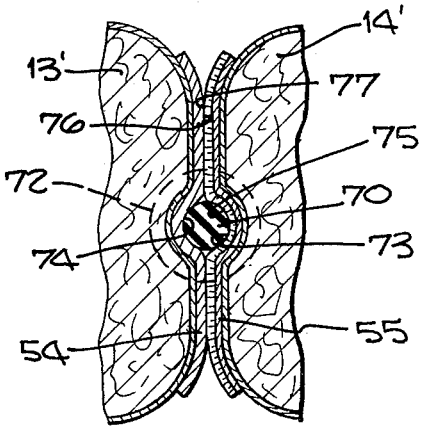
Fig. 11.

INFANT PACIFIER COMBINATION

This is a continuation-in-part of copending application Ser. No. 921,202, filed July 3, 1978, now U.S. Pat. No. 4,188,747.

In the care of infants, it has been common practice to provide the child with some object simulating a nipple of the mother's breast which the child can mouth when not feeding. Although many children are undisturbed during the non-feeding interval, others appear to be not content in the absence of either feeding or simulated feeding. It is also true that occasions may arise when a proper feeding schedule cannot be complied with. A child, anticipating being fed on schedule may become irritable, and even psychologically frustrated unless the feeding is in some way simulated.

Some children even for a period of long after being weaned, continue to anticipate and expect breast or bottle feeding. On occasions psychological problems can arise unless the situation is adequately taken care of.

Pacifiers of rubber-like or plastic material have been commonly used. Quite naturally such objects which are designed to be put in the child's mouth tend to get dirty and unsanitary. Consequently, they need to be such that they can be periodically sterilized, or in any event, cleaned. When such pacifier's are small, as they can be, they often get lost or misplaced when dropped by the child and the purpose of the pacifier is not only defeated but the pacifier also is likely to lodge in some place where dirt has accumulated. Further still, and frequently with older infants and even small children, the customary pacifier, although accepted to a degree, may be found inadequate to satisfy the emotional as well as the physical need of the child.

It is therefore among the objects of the invention to provide a new and improved infant pacifier combination which makes it possible to couple a conventional pacifier object with an animal-like doll or toy to which the child can become affectionately attached and at the same time have the infant craving for the breast physically and emotionally satisfied.

Another object of the invention is to provide a new and improved pacifier combination whereby a mechanical pacifier object can be temporarily attached to a doll or animal-like object in such fashion that when the object is embraced by the infant in a natural way, the pacifier is at a location most convenient to the child's needs.

Still another object of the invention is to provide a new and improved infant pacifier combination wherein when the pacifier object is attached to a doll or other animal-like object the attachment means can be adequately obscured during the time when the pacifier object is attached and to a degree camouflaged when removed so that whatever may be used as a retaining device for the pacifier object, it is located where it will not readily be damaged nor dirtied.

Still further among the objects of the invention is to provide a new and improved infant pacifier combination wherein a doll or animal-like object is provided with a disguised retaining device for the pacifier object of the type such that the object can be readily removed for cleaning and sterilizing and just as readily replaced either with a comparable pacifier object or with the one initially provided after it has been sterilized, the arrangement being such that whatever the retainer may be which is used for the animal-like object it can in no way harm even the smallest infant.

With these and other objects in view, the invention consists of the construction, arrangement, and combination of the various parts of the device, whereby the objects contemplated are attained, as hereinafter set forth, pointed out in the appended claims and illustrated in the accompanying drawings.

FIG. 7 is a front perspective view of a doll supporting one form of the invention.

FIG. 8 is a front perspective view similar to FIG. 7 with the invention in operation.

FIG. 9 is a fragmentary sectional view on the line 9—9 of FIG. 8.

FIG. 10 is a partial perspective view of a doll supporting another form of the invention in operation.

FIG. 11 is a fragmentary sectional view on the line 11—11 of FIG. 10.

Figure 1:
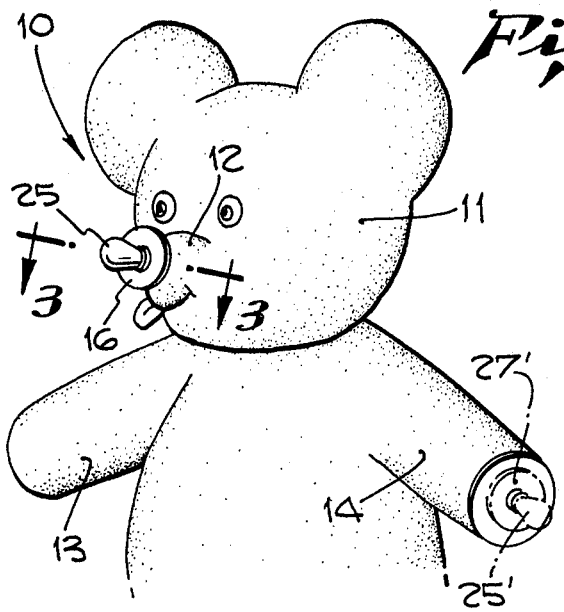
FIG. 1 is a front perspective view of a pacifier combination showing a pacifier object attached to the nose of a doll.
Figure 2:
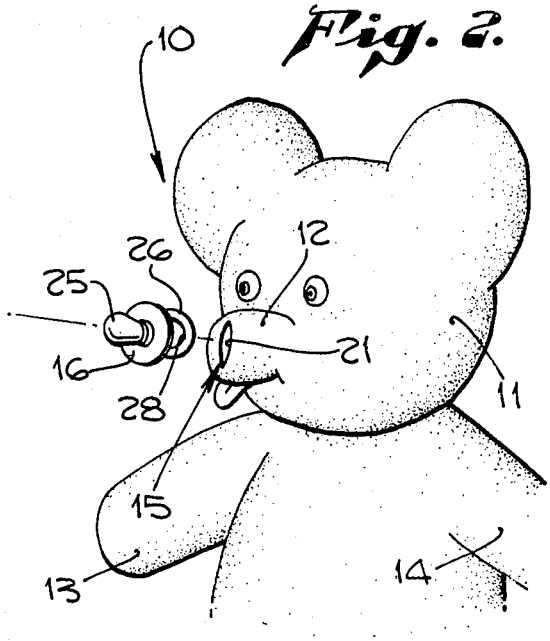
FIG. 2 is a front perspective exploded view similar to FIG. 1 showing the pacifier object removed.

In an embodiment chosen as background for the invention, an animal-like object 10 is depicted, here taking the form of a toy bear. The animal-like object could as readily be a lamb, puppy, kitten or in fact any type of doll-like object attractive to infants and which normally may have a soft or fluffy exterior, so that they can be embraced and cuddled affectionately. The animal-like object which is typical is one being possessed of a head 11 with a nose 12 protruding to a degree outwardly from the head. Arms 13 and 14 are also depicted. Variations in the animal-like object are limited only to the imagination of the designer.

In the form of device of FIGS. 1, 2, 3 and 4 the protuberance here depicted as the nose 12 is provided with a receptacle indicated generally by the reference character 15. For convenience the receptacle is in the form of a slit, although the form might vary appreciably depending on the character of pacifier object or member which may be employed.

The receptacle 15 is made relatively deep and is lined with opposite sidewall portions 17 and 18. On the sidewall portion 17 is an adhesive patch 19 while on the sidewall 18 is a complementary adhesive patch 20. The adhesive patches in the chosen embodiment have appreciable area as compared to the area of the sidewall portions 17 and 18. The patches 19 and 20 are of material such that they will readily stick to each other when moved to the relative positions of FIG. 3, but which can be just as readily separated from each other to the positions of FIG. 4. The patches may be provided with pressure sensitive adhesive or some other adhering type of mechanism such as commercially available Velcro. It is of consequence that the adhesive patches 19 and 20 be located far enough within the receptacle 15 so that there is a short space 21 located outwardly with respect to the patches. Preferably also, there is a space 22 at the bottom of the receptacle which is clear of the material comprising the patches.

The pacifier 16 has a nipple 25 at the one end and a retainer counter-member 26 at the opposite side. Separating the nipple 25 and retainer counter-member 26 is an annular flange 27. The nipple is preferably hollow so that it can be readily squeezed by the teeth of the infant user.

Figure 3:
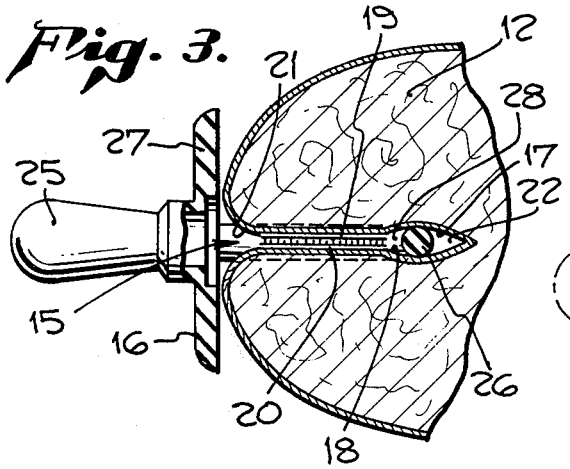
FIG. 3 is a fragmentary sectional view on the line 3—3 of FIG. 1 showing one form of the means of attachment.

In the chosen embodiment the retainer counter-member is in the form of a relatively large ring, which may be of circular cross-sectional shape as shown in FIG. 3. The receptacle 15 having the form of a slit is long enough to freely accommodate the full breadth of the retainer counter-member so that when it is completely received within the receptacle in the position of FIG. 3, the open center 28 of the retainer counter-member will be able to receive the entire area of the adhesive patches 19 and 20 when they are pressed together into engagement with each other. Pressure can readily be applied by reason of the fact that the receptacle is preferably located on some protuberance like the nose 12 which permits opposite sides to be pressed together to engage the adhesive patches. Conversely, when the pacifier member is to be removed opposite sides of the projection, like the nose 12 can be grasped and pulled apart thereby to separate the adhesive engagement of the patches 19 and 20 where, when they are separated to the degree shown in FIG. 4, the pacifier member can readily be removed for sterilizing and for replacement either by the same or another comparable pacifier member.

Figure 5:
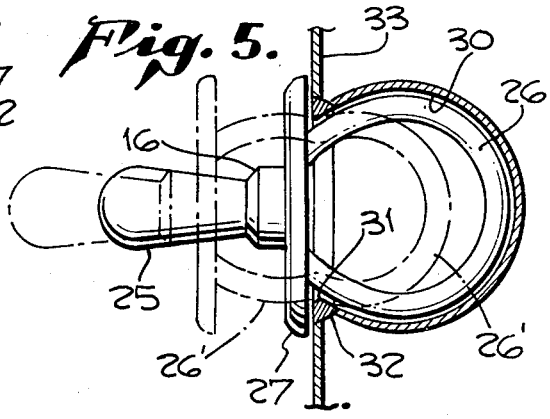
FIG. 5 is a fragmentary sectional view of a modified form of attachment.
Figure 4:
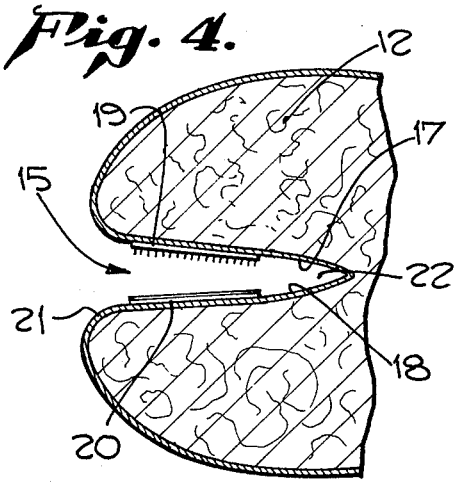
FIG. 4 is a fragmentary sectional view similar to FIG. 3 but with the pacifier object removed.

In the form of device of FIG. 5 the same type of pacifier member is employed but with a receptacle operating on a somewhat different principle. On this occasion the receptacle has an interior pocket 30 large enough to comfortably receive the retainer counter-member 26 when fully extended. The shape of the pocket 30 in a direction at right angles to that shown in FIG. 5 is somewhat arbitrary but can be made only wide enough to freely accommodate the thickness of the counter-member, namely, about as wide as the receptacle 15 when pressed together to the extent shown in FIG. 3. With respect to FIG. 5 it is important to have a perimetrical opening 31 of fixed size and smaller than the fully expanded diameter of the counter-member 26. Because of anticipated wear, the perimetrical opening may be button-holed or provided with some comparable reinforced binding 32 so that it will maintain its size.

When the counter-member is to be employed with a receptacle like that of FIG. 5, it is inserted into the receptacle by squeezing the counter-member to a slightly smaller dimension as shown by the broken line 26' of FIG. 5. It is necessary to squeeze the counter-member only enough to permit it to pass the perimetrical opening 31 whereafter the counter-member will expand to the solid line position 26 of FIG. 5, drawing the flange 27 close to engagement with a surface 33 of the animal-like object. In this form of device the pacifier member need not be applied to a protuberance needing to be squeezed or pulled apart, but on the contrary can be applied to a relatively extended flat surface.

Figure 6:
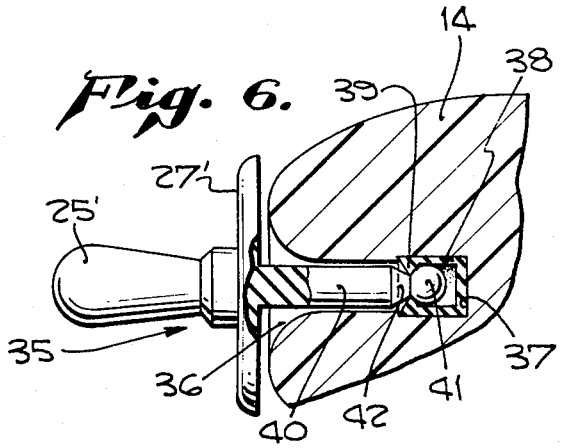
FIG. 6 is a fragmentary sectional view of still another form of attachment.

In the form of device of FIG. 6 it may be assumed merely by way of example that a pacifier member 35 is to be applied at the end of the arm 14, or other comparable protuberance. The receptacle 36 is this instance may be circular in cross section but will, in any event, be relatively deep to provide a pocket 37. In the pocket is a fitting 38 having elastic properties so as to provide a perimetrical bead 39 close to the bottom of the receptacle 36. In this form of the device on the side of the pacifier member 35 opposite from the nipple 25' is a post 40 terminating in a knob 41, the post being separated from the nipple 25 by a flange 27'. Between the knob 41 and the post 40 is a recess 42 which is adapted to receive the bead 39 when it contracts, after having been expanded by projection of the knob 41 through the space formed by the bead. In this position, as shown in FIG. 6, the bead serves to act against the knob 41 serving as a shoulder thereby to releasably retain the pacifier member 35 in position in the receptacle. When the pacifier member is to be removed it is merely forcibly pulled outwardly when again the bead 39 will be expanded temporarily as the knob 41 is pulled past.

Although protuberances such as the doll's nose and the end of the arm are suggested as a likely protuberance or appendage, other appendages or protuberances may be taken advantage of as, for example, the legs or breasts.

In the form of invention of FIGS. 7 through 11 the same animal-like object 10 may be employed with appendages in the form of arms 13' and 14' extending from opposite sides of a body 50 at the location of a shoulder portion 51. The arms terminate in respective paws 52 and 53. Appendages such as legs (not shown) could also be employed.

On the paw 52 is a patch 54, a complementary patch 55 being attached to the paw 53, the patches giving the suggestive effect of paw surfaces. The patches serve as mutually engageable retainers when brought together. Although mats of plastic resilient hooks may serve as one patch releasably engageable with corresponding loops on the other, the important structure is one where the patches, when pushed into engagement, are releasably interlocked but can be pulled apart by hand when the need arises, as for example structures as depicted in FIGS. 5 and 6.

In a sense the patches when brought together serve as a potential receptacle, part or all of which may be separated to form a pocket with a forward open end.

When the pacifier member 16 is made use of with the retainer counter-member 26 in the form of a ring with its open center, it is slid into position between the patches 54, 55 and the patches pressed together into engagement with each other. Inner portions 56, 57 within the ring which engage each other releasably lock the ring 26 in place, and hence the pacifier. Outer portions 58, 59 may also be interlocked if desired. In this manner the pacifier appears to be held by the two paws in an offering position, as in FIG. 8.

A pacifier 35', somewhat similar to the pacifier 35 of FIG. 6, may also be employed. In this form the retainer counter-member is in the form of a post 70 on the side opposite a nipple 71. An enlargement in the form of a ball 72 at the free end of the post 70 forms a configuration relative to the post as does the recess 42 of FIG. 6.

When the combination of FIGS. 10 and 11 is put together, the post 70 is, in effect, received within a receptacle 73 formed by opposite inner portions 74 and 75 of the respective patches 54, 55, with an outwardly open end. The ball 72 extends beyond an inwardly open end of the receptacle. Outer portions 76, 77 of the patches releasably engage each other and hold the combination in assembled relationship.

While particular embodiments of the present invention have been shown and described, it will be obvious to those skilled in the art that changes and modifications may be made without departing from the invention in its broader aspects, and therefore, the aims of the appended claims is to cover all such changes and modifications as fall within the true spirit and scope of this invention.

Having described the invention, what is claimed as new in support of Letters Patent is as follows:

1. An infant pacifier combination in the form of a doll-like body naturally attractive to and of size for being embraced by a human infant, said combination comprising a body having appendage means, a receptacle formed in part from said appendage means, said receptacle comprising opposing parts of outer ends of said appendage means in juxtaposition when in operation, complementary mutually engageable patches on respective opposing parts adapted to engage each other in a releasable engaging relationship forming in effect a potential outwardly facing opening for the receptacle and open to the exterior, sides of said receptacle comprising the patches being adapted to act as a releasable yieldable holder, a pacifier member having a nipple-like protrusion on one side and a retainer counter-member on the opposite side, at least a part of the retainer counter-member being complementary with respect to the yieldable holder when said retainer counter-member is located within the receptacle, whereby the pacifier member is held releasably in place on the body.

2. An infant pacifier combination as in claim 1 wherein the retainer counter-member of the pacifier member has an opening therein for reception of portions of the patches where they engage each other.

3. An infant pacifier combination as in claim 2 wherein said portions of the patches where they engage each other comprise mutually engaging releasable adhesive means and the area of engagement of said patches exceeds the area of the retainer counter-member.

4. An infant pacifier combination as in claim 1 wherein the retainer counter-member comprises an extension with configuration means thereon, the configuration means of said extension having an operative location enveloped by said patches when said retention counter-member is located within said receptacle.

5. An infant pacifier combination as in claim 1 wherein the retainer counter-member comprises a shaft having a free end remote from the nipple-like protrusion, a knob on said free end of the shaft, said shaft having an operative location enveloped by the patches when the retainer counter-member is located within said receptacle.

* * * * *